US007090468B2

(12) United States Patent
Brueckner

(10) Patent No.: US 7,090,468 B2
(45) Date of Patent: Aug. 15, 2006

(54) FASTENING OF MOVING TURBOMACHINE BLADES

(75) Inventor: Gerhard Brueckner, Altomuenster (DE)

(73) Assignee: MTU Aero Engines GmbH, Munich (DE)

( * ) Notice: Subject to any disclaimer, the term of this patent is extended or adjusted under 35 U.S.C. 154(b) by 92 days.

(21) Appl. No.: 10/480,164

(22) PCT Filed: Apr. 25, 2002

(86) PCT No.: PCT/DE02/01509

§ 371 (c)(1),
(2), (4) Date: Apr. 28, 2004

(87) PCT Pub. No.: WO02/103166

PCT Pub. Date: Dec. 27, 2002

(65) Prior Publication Data

US 2004/0184917 A1 Sep. 23, 2004

(30) Foreign Application Priority Data

Jun. 14, 2001 (DE) ..... 101 28 505

(51) Int. Cl.
*F01D 5/32* (2006.01)

(52) U.S. Cl. ..... 416/221; 416/204 A; 416/248

(58) Field of Classification Search ..... 416/221, 416/204 A, 248

See application file for complete search history.

(56) References Cited

U.S. PATENT DOCUMENTS

| | | | | |
|---|---|---|---|---|
| 4,389,161 A | | 6/1983 | Brumen | |
| 4,444,544 A | | 4/1984 | Rowley | |
| 5,302,086 A | * | 4/1994 | Kulesa et al. | 416/221 |
| 5,445,499 A | * | 8/1995 | Charbonnel | 416/220 R |
| 5,727,927 A | | 3/1998 | Luxenburger | |

FOREIGN PATENT DOCUMENTS

| | | |
|---|---|---|
| DE | 31 48 984 A1 | 7/1982 |
| DE | 31 48 985 C2 | 11/1993 |
| DE | 195 16 694 A1 | 11/1996 |
| JP | 55017616 | 2/1980 |

OTHER PUBLICATIONS

International Search Report.

* cited by examiner

*Primary Examiner*—Ninh H. Nguyen
(74) *Attorney, Agent, or Firm*—Crowell & Moring LLP

(57) ABSTRACT

A fastening device for fastening moving blades to a disk of a turbomachine rotor includes moving-blade roots which have a mirror-symmetrical cross section with projections, axial disk slots holding the moving-blade roots in a positive-locking manner, and one riveted joint per moving blade for axially fixing the latter. Each blade root and the disk, in the region of each moving-blade root, have axial extensions. The extensions of moving blade and disk are opposite one another in pairs, in each case a hole lying in a radial plane relative to the disk axis is formed half in the extension of the moving blade and half in the extension of the disk. A rivet is inserted into each hole and fixed by plastic deformation.

26 Claims, 1 Drawing Sheet

FASTENING OF MOVING TURBOMACHINE BLADES

BACKGROUND AND SUMMARY OF THE INVENTION

This application is a national phase of International Patent Application No. PCT/DE02/01509, filed Apr. 25, 2002, designating the United States of America, and published in German as WO 02/103166 A1, the entire disclosure of which is incorporated herein by reference. Priority is claimed based on Federal Republic of Germany Patent Application No. 101 28 505.1, filed Jun. 14, 2001.

The invention relates to the fastening of moving blades to a disk of a turbomachine rotor. Especially preferred embodiments of the invention relate to fastening of moving blades to a disk of a gas turbine rotor, having moving-blade roots which, at least over most of their axial length, have a constant cross section with mirror-symmetrical toothlike or wavelike projections, having at least mainly axially running disk slots holding the moving-blade roots in a positive-locking manner in the radial direction and in the circumferential direction, and having in each case one riveted joint per moving blade for axially fixing the latter to the disk.

It is normal practice to provide turbine moving blades of gas turbines with toothed or wavelike roots, often referred to as "fir-tree roots", and to hold these roots in axial disk slots in a positive-locking manner. The contact surfaces of root and slot absorb the radial centrifugal force and also flow- and acceleration-induced circumferential forces and bending moments. The axial forces have to be transmitted by additional elements. There are a number of possibilities for this, such as, for example, stop surfaces on one side of the blade roots, and plates, rings, wires, etc., which catch in slots on the other side of the blade roots in a positive-locking manner. Screwed fastenings are also known, screw holes and threads in the highly loaded disks being very critical from a strength point of view.

German Patent Document DE 195 16 694 A1 (corresponding U.S. Pat. No. 5,727,927) discloses fastening of the generic type which provides a riveted joint for absorbing the axial forces. There is one rivet per moving blade, and this rivet is directed axially between moving-blade root and disk-groove bottom from one end face to the opposite end face of the disk. The two rivet heads rest on seating plates which can compensate for small dimensional tolerances between blade and disk. During the disk exchange, the rivet heads can be removed, for example by drilling, without the risk of damaging the disk or the blade. The relatively inexpensive seating plates are renewed in any case, so that damage to them during the removal of the rivet is not important. It is admitted that this solution is relatively simple, inexpensive and easy to assemble and repair. One disadvantage, however, is that the disk slots in relation to the blade root have to be deeper than without a rivet or that there is room for only one rivet of relatively small cross section. A further, more serious disadvantage lies in the fact that the axial forces in the region of the seating plates are directed into the rivet heads, in the course of which the entire rivet head is under tensile stress. There may be an acute risk of fracture under tensile stress due to the notch effect at the shank/head transitions. At least plastic deformations may occur, which increasingly loosen the joint.

Against this background, an object of the present invention is to provide moving-blade fastening having a riveted joint, which fastening, with a moderate design outlay and considerable ease of assembly and repair and also a small space requirement, is markedly better in terms of strength and is therefore safer and more reliable.

This object is achieved according to especially embodiments of the invention by producing a turbomachine rotor, in particular of turbine moving blades to a disk of a gas turbine rotor, having moving-blade roots which, at least over most of their axial length, have a constant cross section with mirror-symmetrical toothlike or wavelike projections, having at least mainly axially running disk slots holding the moving-blade roots in a positive-locking manner in the radial direction and in the circumferential direction, and having in each case one riveted joint per moving blade for axially fixing the latter to the disk, characterized in that both each moving-blade root and the disk, in the region of each moving-blade root, in each case have an axial, integral extension, in that the extensions of moving blade and disk are opposite one another in pairs at a slight distance apart or in mutual contact, in that in each case a hole lying with its axis in a radial plane, i.e. in a transverse plane relative to the rotation axis of the disk, is formed approximately half in the extension of the moving-blade root and approximately half in the extension of the disk, and in that a rivet is inserted into each hole and fixed by plastic deformation.

An important aspect of certain preferred embodiments of the invention lies in the fact that each rivet is arranged in a radial plane relative to the rotation axis of the disk and thus transversely to the axial forces which occur. Therefore only the rivet shank is subjected to shearing load; the rivet heads are free of load to the greatest possible extent. Tensile forces occur, if at all, only in a magnitude which does not present a problem, since they only result from acceleration forces and centrifugal forces from the low rivet mass. Rivets having a relatively large shank diameter, i.e. large thickness, can be used, with the advantage of low surface pressure and small shearing stresses in the shank. The "hole halves" in the extensions of the moving-blade roots and of the disks enclose the rivet shanks to the greatest possible extent and provide for a favorable introduction of force.

Preferred configurations of the fastening according to the invention are described herein and in the claims.

DETAILED DESCRIPTION OF THE DRAWINGS

Figure 1:
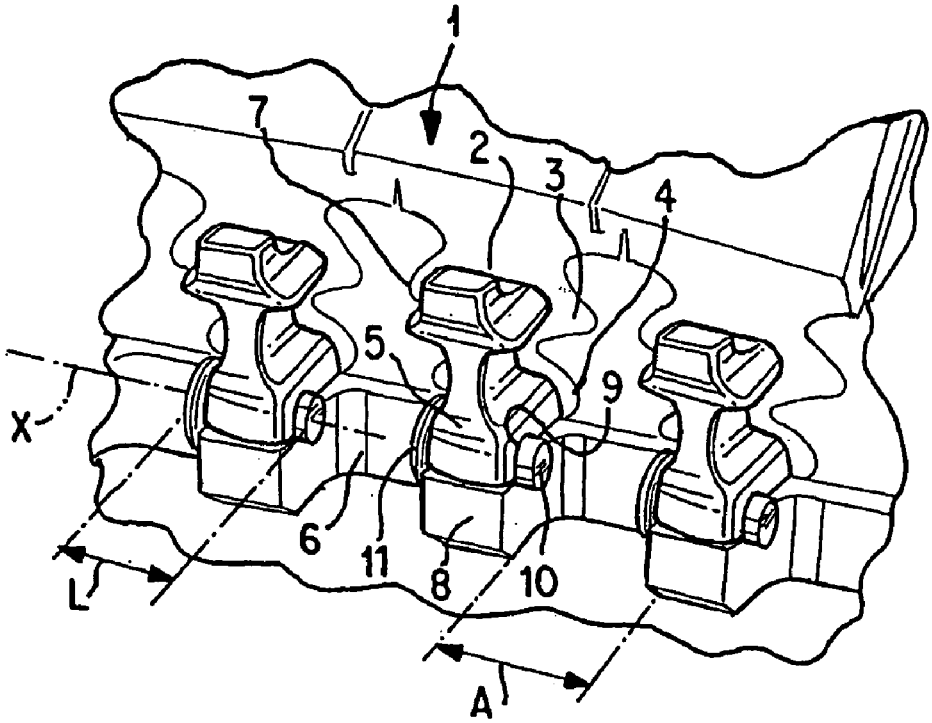
FIG. 1 shows a three-dimensional partial view of the fastening region of three moving blades on a disk, constructed according to preferred embodiments of the invention.

FIG. 1 is the copy of a three-dimensional computer graphic representation which, taking three moving blades 1 on a disk 6 as an example, shows the fastening according to the invention. Of the moving blades 1, in each case only the platform close to the disk, i.e. the inner annular space boundary, and the moving-blade root 2 can be seen. The respective airfoil lies above the representation. Each moving-blade root 2 is designed fir-tree-like in cross section with two mirror-symmetrical projections 3, 4 on each side and is held in a positive-locking manner by a disk slot 7. As a rule, the disk slots 7 run axially, but they may also be disposed at a small angle to the axial direction by defined rotation about an imaginary radial axis, e.g. the fitting axis of the blade profiles. However, this is of no importance for describing the principle of the invention.

The moving-blade roots 2 and the disk 6 have axial extensions 5, 8 which in each case are opposite one another in pairs. Formed in a pair of extensions 5, 8 is a common hole 9, into which a rivet 10 is inserted and fixed by plastic deformation. As an example, rivets 10 having a countersunk head 11 are shown in the still undeformed state in FIG. 1. The axes X of the holes 9 and thus of the rivets 10 lie tangentially on an imaginary circle (not shown) concentric to the rotation axis of the disk 6. The smallest distance A in the circumferential direction between the extensions 8 at adjacent blade positions is greater than the length L of an undeformed rivet 10 in order to be able to fit and rivet the latter. In this case, the space required by the riveting tool is also to be taken into account. In deviation from the tangential orientation shown of the hole and rivet axes X, said hole and rivet axes X may also be oriented in their common radial plane in any desired angular position between tangential and radial and also in a purely radial position. In this case, the extensions also ought to be adapted in their position if need be. Inclinations right up to radial arrangements may result in advantages in terms of assembly, although centrifugal force components then act in the rivet longitudinal direction and lateral forces also act on the moving-blade roots. However, it is ultimately decisive for absorbing the axial blade forces that the hole and rivet axes remain in a common radial plane relative to the disk axis. Of course, the axis orientation relative to the local tangential or radial direction is to be identical for each rivet at the disk circumference.

Figure 2:
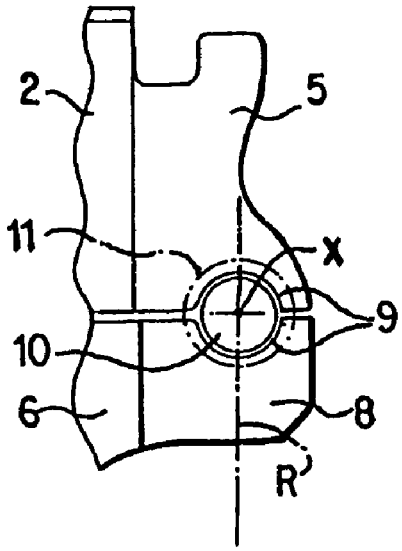
FIG. 2 shows a partial view of the region of the rivet fastening of FIG. 1 in the longitudinal direction of the rivet.

For further clarification, FIG. 2 shows a partial view in the direction of the X axis of the hole 9 and thus of the rivet 10. Indicated vertically by chain line is the radial plane R, which is disposed transversely to the rotation axis of the disk 6 and in which the axes X of all the holes 9 and rivets 10 are to lie, here with tangential orientation as in FIG. 1. It can be seen that the axial extension 5 of the moving-blade root 2 and the axial extension 8 of the disk 6 are opposite one another at a slight radial distance apart. It can also be seen that the hole 9 is in each case formed half in the extension 5 and half in the extension 8, the rivet 10 being enclosed to the greatest possible extent. The countersunk head 11 of the rivet 10 is indicated here by dot-dash line. It has already been mentioned that rivets having various head shapes can be used. In this case, it is to be taken into account that the rivets have to be capable of being removed/exchanged without damaging blades and disk. Countersunk-head-like rivets are in this case probably easier to grip and cut off than heads with large, flat bearing surfaces.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

The invention claimed is:

1. A fastening device for fastening moving blades to a disk of a turbomachine rotor, comprising moving-blade roots which, at least over most of their axial length, have a constant cross section with mirror-symmetrical toothlike or wavelike projections, at least mainly axially running disk slots holding the moving-blade roots in a positive-locking manner in the radial direction and in the circumferential direction, and in each case one riveted joint per moving blade for axially fixing the moving blade to the disk, wherein both each moving-blade root and the disk, in the region of each moving-blade root, in each case have an axial, integral extension, wherein the extensions of the moving blade and disk are opposite one another in pairs at a slight distance apart or in mutual contact, wherein in each case a hole lying with its axis in a radial plane, i.e. in a transverse plane relative to the rotation axis of the disk, is formed approximately half in the extension of the moving-blade root and approximately half in the extension of the disk, and wherein a rivet is inserted into each hole and fixed by plastic deformation and further wherein the rivet is a commercial, rotational rivet having a concentric head with a larger diameter than a diameter of a cylindrical shaft of the rivet.

2. The fastening device as claimed in claim 1, wherein all the holes formed in the extension of the moving-blade roots and in the extensions of the disk, with their axes, relative to the rotation axis of the disk, are oriented in the same manner either tangentially or with defined inclination with tangential and radial components or radially.

3. The fastening device as claimed in claim 2, with tangentially oriented holes, wherein the extensions, arranged in pairs, of the moving-blade roots and of the disk are at a minimum distance apart in the circumferential direction from one blade position to an adjacent blade position, this distance being greater in a defined manner than the length of an undeformed rivet.

4. The fastening device as claimed in claim 3, wherein rivets having a button head and flat head-bearing surface or rivets having a countersunk head are used.

5. The fastening device as claimed in claim 1, wherein the rivet material has a lower mechanical strength and hardness than the material of the moving blade and the material of the disk in each case in the region of the extensions.

6. The fastening device as claimed in claim 1, wherein rivets having a button head and flat head-bearing surface or rivets having a countersunk head are used.

7. The fastening device as claimed in claim 6, wherein rivets having a countersunk head are used and wherein the holes are provided with a matching countersink on the rivet-head side.

8. A fastening device for fastening moving blades to a disk of a turbomachine rotor, comprising moving-blade roots which, at least over most of their axial length, have a constant cross section with mirror-symmetrical toothlike or wavelike projections, at least mainly axially running disk slots holding the moving-blade roots in a positive-locking manner in the radial direction and in the circumferential direction, and in each case one riveted joint per moving blade for axially fixing the moving blade to the disk, wherein both each moving-blade root and the disk, in the region of each moving-blade root, in each case have an axial, integral extension, wherein the extensions of the moving blade and disk are opposite one another in pairs at a slight distance apart or in mutual contact, wherein in each case a hole lying with its axis in a radial plane, i.e. in a transverse plane relative to the rotation axis of the disk, is formed approximately half in the extension of the moving-blade root and approximately half in the extension of the disk, and wherein a rivet is inserted into each hole and fixed by plastic deformation, wherein all the holes formed in the extension of the moving-blade roots and in the extensions of the disk, with their axes, relative to the rotation axis of the disk, are oriented in the same manner with tangentially oriented holes, wherein the extensions, arranged in pairs, of the moving-blade roots and of the disk are at a minimum distance apart in the circumferential direction from one blade position to an adjacent blade position, this distance being greater in a defined manner than the length of an undeformed rivet.

9. The fastening device as claimed in claim 8, wherein rivets having a button head and flat head-bearing surface or rivets having a countersunk head are used.

10. The fastening device as claimed in claim 9, wherein commercially available standard rivets are used.

11. The fastening device as claimed in claim 10, wherein the rivet material has a lower mechanical strength and hardness than the material of the moving blade and the material of the disk in each case in the region of the extensions.

12. The fastening device as claimed in claim 9, wherein rivets having a countersunk head are used and wherein the holes are provided with a matching countersink on the rivet-head side.

13. A fastening device for fastening a blade to a disk of a turbomachine rotor, the device comprising a blade root of the blade having wavelike projections;

a slot on the disk for receiving the wave-like projections of the blade root, which slot is mainly oriented in an axial direction of the rotor and lockingly holds the blade root in a radial direction of the rotor and in the circumferential direction of the rotor, and a rivet, wherein each of the blade root and the disk has an extension, wherein a hole, an axis of which is in a radial plane of the rotor, extends through the extensions of the blade root and disk, and wherein the rivet is inserted into and fixed in the hole and further wherein the rivet is a commercial, rotational rivet having a concentric head with a larger diameter than a diameter of a cylindrical shaft of the rivet.

14. The fastening device as claimed in claim 13, wherein the axis of the hole is oriented within a range between the tangential and radial directions of the rotor.

15. The fastening device as claimed in claim 14, further comprising another pair of a blade root and a disk each having an extension, where the axis of the hole is in the tangential direction of the rotor, and wherein a circumferential distance between the extension of the blade root of one pair and the extension of the disk of the other pair is greater than a length of the rivet before the rivet is deformed.

16. The fastening device as claimed in claim 15, wherein the rivet has a button head and flat head-bearing surface.

17. The fastening device as claimed in claim 15, wherein the rivet has a countersunk head, and the hole has a matching countersink.

18. The fastening device as claimed in claim 13, wherein the rivet is made from a material that has a lower mechanical strength and hardness than a material from which the extension of the blade is made and a material from which the extension of the disk is made.

19. The fastening device as claimed in claim 13, wherein the rivet has a countersunk head, and the hole has a matching countersink.

20. The fastening device as claimed in claim 13, wherein the rivet has a button head and flat head-bearing surface.

21. A fastening device for fastening a blade to a disk of a turbomachine rotor, the device comprising a blade root of the blade having wavelike projections;

a slot on the disk for receiving the wave-like projections of the blade root, which slot is mainly oriented in an axial direction of the rotor and lockingly holds the blade root in a radial direction of the rotor and in the circumferential direction of the rotor, and a rivet, wherein each of the blade root and the disk has an extension, wherein a hole, an axis of which is in a radial plane of the rotor, extends through the extensions of the blade root and disk, and wherein the rivet is inserted into and fixed in the hole and wherein the axis of the hole is oriented within a range between the tangential and radial directions of the rotor and further comprising another pair of a blade root and a disk each having an extension, where the axis of the hole is in the tangential direction of the rotor, and wherein a circumferential distance between the extension of the blade root of one pair and the extension of the disk of the other pair is greater than a length of the rivet before the rivet is deformed.

22. The fastening device as claimed in claim 21, wherein the rivet has a button head and flat head-bearing surface.

23. The fastening device as claimed in claim 21, wherein the rivet has a countersunk head, and the hole has a matching countersink.

24. The fastening device as claimed in claim 21, wherein the rivet is made from a material that has a lower mechanical strength and hardness than a material from which the extension of the blade is made and a material from which the extension of the disk is made.

25. A fastening device for fastening a blade to a disk of a turbomachine rotor, the device comprising a blade root of the blade having wavelike projections;

a slot on the disk for receiving the wave-like projections of the blade root, which slot is mainly oriented in an axial direction of the rotor and lockingly holds the blade root in a radial direction of the rotor and in the circumferential direction of the rotor, and a rivet, wherein each of the blade root and the disk has an extension, wherein a hole, an axis of which is in a radial plane of the rotor, extends through the extensions of the blade root and disk, and wherein the rivet is inserted into and fixed in the hole and further wherein the rivet has a countersunk head, and the hole has a matching countersink.

26. A fastening device for fastening a blade to a disk of a turbomachine rotor, the device comprising a blade root of the blade having wavelike projections;

a slot on the disk for receiving the wave-like projections of the blade root, which slot is mainly oriented in an axial direction of the rotor and lockingly holds the blade root in a radial direction of the rotor and in the circumferential direction of the rotor, and a rivet, wherein each of the blade root and the disk has an extension, wherein a hole, an axis of which is in a radial plane of the rotor, extends through the extensions of the blade root and disk, and wherein the rivet is inserted into and fixed in the hole and further wherein the rivet has a button head and flat head-bearing surface.

* * * * *